United States Patent [19]

Jones et al.

[11] 4,444,081

[45] Apr. 24, 1984

[54] ARPEGGIO GENERATING SYSTEM AND METHOD

[75] Inventors: Edward M. Jones, Cincinnati; Carlton J. Simmons, Jr., Westchester, both of Ohio

[73] Assignee: Baldwin Piano & Organ Company, Cincinnati, Ohio

[21] Appl. No.: 384,856

[22] Filed: Jun. 4, 1982

[51] Int. Cl.[3] ..... G10F 1/00

[52] U.S. Cl. ..... 84/1.03; 84/1.24; 84/DIG. 12

[58] Field of Search ..... 84/1.03, 1.24, DIG. 12, 84/1.01

[56] References Cited

U.S. PATENT DOCUMENTS

| | | | |
|---|---|---|---|
| 4,156,379 | 5/1979 | Studer | 84/1.03 |
| 4,158,978 | 6/1979 | Hiyoshi et al. | 84/1.03 |
| 4,187,756 | 2/1980 | Robinson et al. | 84/1.03 |
| 4,232,581 | 11/1980 | Uchiyama | 84/1.03 |
| 4,267,762 | 5/1981 | Aoki et al. | 84/1.03 |
| 4,271,741 | 6/1981 | Hoskinson et al. | 84/1.03 |
| 4,339,978 | 7/1982 | Imamura | 84/1.03 |

*Primary Examiner*—F. W. Isen

*Attorney, Agent, or Firm*—Kirkland & Ellis

[57] ABSTRACT

In an electronic musical instrument, an apparatus and method are described for automatically generating arpeggios from selected chords while requiring only a minimum amount of performance sophistication and dexterity. In the preferred embodiment, a plurality of voice priority switches are included, each of which corresponds to a voice-related rhythmic pattern or an arpeggio variation of tones played. The desired variation of the voice-related rhythmic pattern of tones is implemented as selected notes are played. The played notes and corresponding notes in higher octaves are stored in a random access memory and subsequently accessed by a microprocessor which searches up or down in frequency to find the available notes in the random access memory. Subsequently, the microprocessor converts chosen notes to audible tones. The system of the subject invention, under certain predetermined conditions, reverses the order of search whenever the highest or lowest notes are reached or exceeded, stops the search, and produces a five-note trill. Further, the system of the subject invention, under certain predetermined conditions, skips one or more active notes during a search and immediately searches for another note in the chord or changes the direction of search in the middle of the chord or sequence.

32 Claims, 7 Drawing Figures

TO LATCHES FOR DAMPING
4 LINE TO 10 LINE DECODER
18
18d
18c
18b
18a
18e
18f
18g
18h
10j
10k
10l
10m
PORT 4
10
EXTERNAL INTERRUPT
10i
MICROPROCESSOR
PORT 0
B0
B1
B2
B3
B4
B5
B6
B7
10a
10b
10c
10d
10e
10f
10g
10h
12
ORGAN
14
16
a b c d e f g h i j k l m
C0
C5
B5
A#5
A5
C4
B4
A#4
A4
C3
B3
A#3
A3
C2
B2
A#2
A2
C1
B1
A#1
A1
G#5
G5
F#5
F5
E5
D#5
D5
C#5
G#4
G4
F#4
F4
E4
D#4
D4
C#4
G#3
G3
F#3
F3
E3
D#3
D3
C#3
G#2
G2
F#2
F2
E2
D#2
D2
C#2
G#1
G1
F#1
F1
E1
D#1
D1
C#1

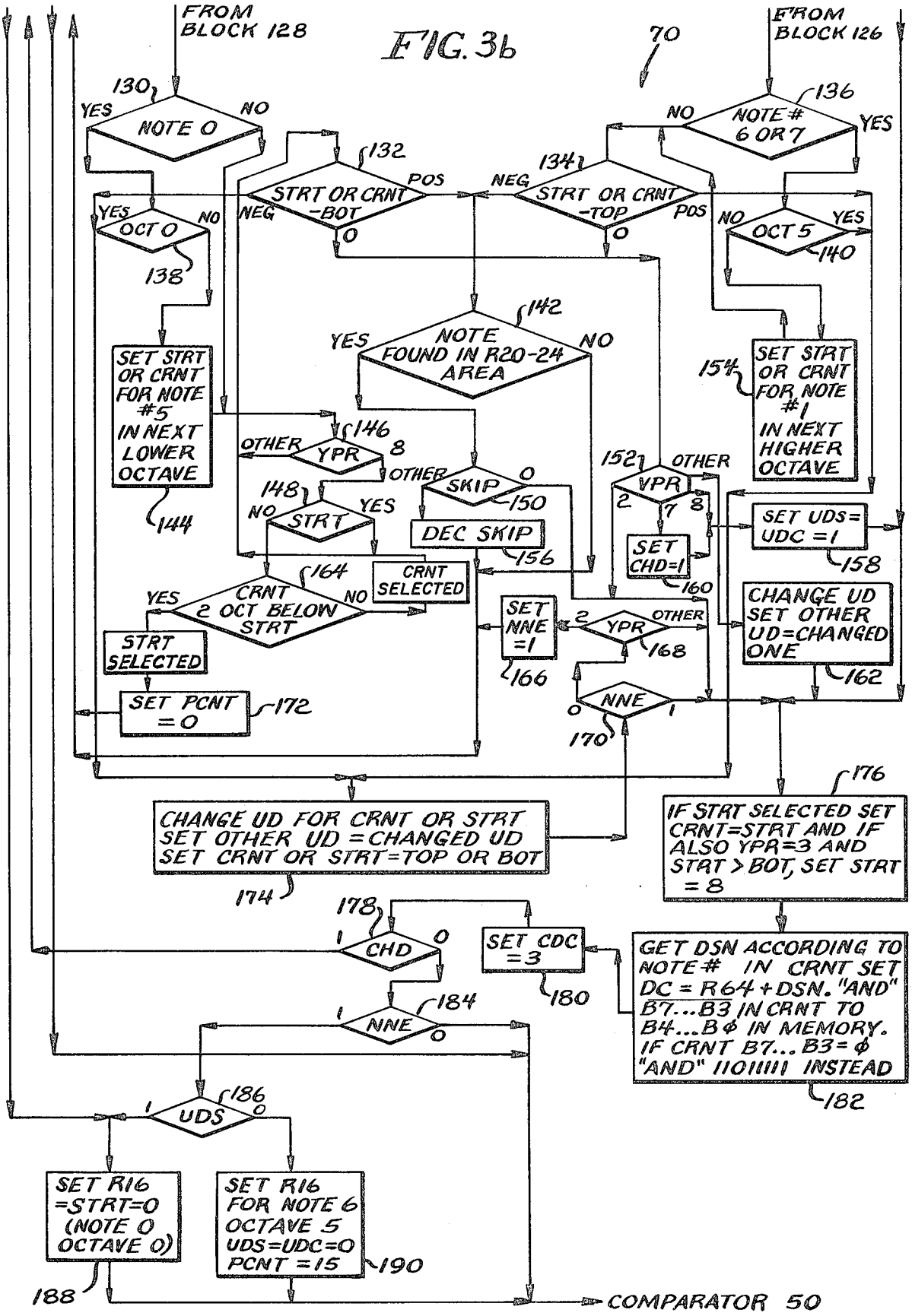
FIG. 3b
70
FROM BLOCK 128
FROM BLOCK 126
130
NOTE 0
YES
NO
132
STRT OR CRNT -BOT
POS
NEG
0
134
STRT OR CRNT -TOP
136
NOTE # 6 OR 7
OCT 0
138
OCT 5
140
142
NOTE FOUND IN R20-24 AREA
SET STRT OR CRNT FOR NOTE #5 IN NEXT LOWER OCTAVE
144
SET STRT OR CRNT FOR NOTE #1 IN NEXT HIGHER OCTAVE
154
146
YPR
OTHER
8
148
STRT
SKIP
150
DEC SKIP
156
152
VPR
2
7
SET CHD=1
160
SET UDS= UDC =1
158
164
CRNT 2 OCT BELOW STRT
CRNT SELECTED
STRT SELECTED
SET PCNT =0
172
SET NNE =1
166
168
NNE
170
CHANGE UD SET OTHER UD=CHANGED ONE
162
CHANGE UD FOR CRNT OR STRT SET OTHER UD =CHANGED UD SET CRNT OR STRT=TOP OR BOT
174
176
IF STRT SELECTED SET CRNT=STRT AND IF ALSO YPR=3 AND STRT > BOT, SET STRT =8
178
CHD
SET CDC =3
180
GET DSN ACCORDING TO NOTE# IN CRNT SET DC = R64 + DSN. "AND" B7...B3 IN CRNT TO B4...B0 IN MEMORY. IF CRNT B7...B3 = 0 "AND" 1101111 INSTEAD
182
184
NNE
186
UDS
SET R16 =STRT=0 (NOTE 0 OCTAVE 0)
188
SET R16 FOR NOTE 6 OCTAVE 5 UDS=UDC=0 PCNT =15
190
COMPARATOR 50

ARPEGGIO GENERATING SYSTEM AND METHOD

BACKGROUND OF THE INVENTION

The present invention relates to apparatus for automatically generating arpeggios from played chords on an electronic musical instrument and, more particularly, to apparatus for automatically providing a wide variety of musically sophisticated tonal sequences under microprocessor control while requiring only a minimum amount of sophistication and dexterity on the part of the person playing the instrument.

Electronic musical instruments which automatically generate arpeggios are known in the art. Such systems, as those disclosed in U.S. Pat. Nos. 3,718,748, 3,822,407, 3,842,182, and 4,137,809, all in the name of Bunger; U.S. Pat. No. 3,725,562-Munch, et al.; and U.S. Pat. No. 3,842,184-Kniepkamp, et al., provide a fully automatic arpeggio initiated by the playing of one or more keys and terminated by the release of the keys. These arpeggio systems provide up, down, and up/down tonal sequences. However, an arpeggio played by a skilled musician may include a variety of fanciful, tonal sequences in addition to the up, down, and up/down sequences, none of which are provided by these prior art automatic systems.

The next generation of arpeggio systems, as disclosed in U.S. Pat. Nos. 4,154,131 and 4,156,379, both in the name of Studer, et al., provided a variety of tonal sequences in addition to the up, down, and up-down arpeggios. However, the artistic use of these new variations requires a greater musical sophistication and performance capability on the part of the musical performer than that of a musical amateur. In contrast, a musical beginner can play musical instruments, including electronic organs, incorporating the present invention to provide a wide variety of musically sophisticated tonal sequences.

BRIEF DESCRIPTION OF THE INVENTION

The present invention comprises an improved system and method for the generation of arpeggios from selected chords on an electronic musical instrument, such as an electric organ having an array of playing keys corresponding to a plurality of octaves. The improved arpeggio-generating system enables the user to preselect one or more voice-related rhythmic patterns and arpeggio variations of these tones before playing a chord on the organ's keyboard. Priority of the voice-related patterns and their arpeggio variations depends upon the order in which the particular patterns and variations are selected. Thereafter, by playing a particular chord, the played notes and their corresponding notes in higher octaves are selected to form an array (up to a maximum of twenty-six notes in the array) which is stored in a microprocessor's random access memory. An arpeggio is formed from this array. The selected notes in the random access memory may include up to five octaves of five different notes plus a sixth octave comprising a low C. Normally less than five different notes are played. The notes in octaves below each played note are not stored. The exact position of each played note of the chord with respect to the note C is also stored. In addition, data representing the lowest and highest notes played, the preselected rhythm rate, the selected voice variation, and the desired up or down movement in pitch of the arpeggio are stored in the random access memory. The microprocessor then searches the array of selected notes for the beginning note of a note group or the note within a selected note group, depending upon the preselected voice-related rhythmic pattern. When a note is detected, data is transferred to another memory area representing the desired condition of the latches which control which notes will be sounded. Thereafter, this data is converted to audible tones and the next available note for the preselected pattern variation is searched for and sounded. The system of the present invention can reverse the order of search whenever the highest or lowest notes are reached or exceeded, stop the search, and produce a five note trill. Further, the present invention can skip one or more active notes during a search and immediately search for another note to be played simultaneously in a chord, or change the direction of search, as the situation dictates.

The principal object of the present invention is to provide an improved arpeggio-generating system for performing sophisticated tonal sequences.

It is a further object of the present invention to provide a system by which amateur musicians may generate sophisticated musical sequences.

These and other objects and advantages of the present invention are presented, by way of illustration and not limitation, by the following detailed description of a preferred embodiment of the present invention.

BRIEF DESCRIPTION OF THE DRAWINGS

FIGS. 3*a* and 3*b* taken together constitute a flow chart detailing block 70 of FIG. 2.

DETAILED DESCRIPTION OF THE PREFERRED EMBODIMENT

Figure 1:
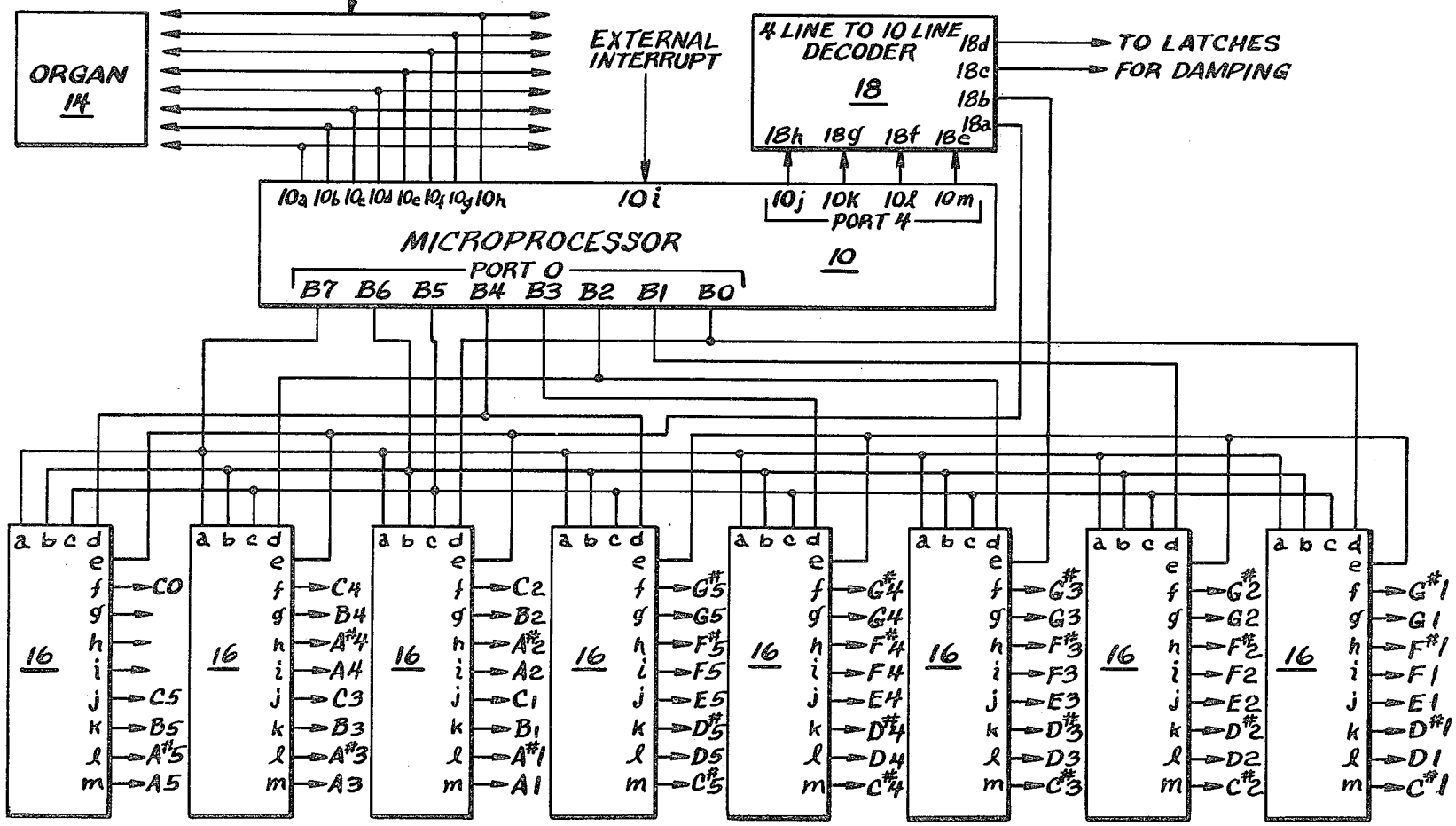
FIG. 1 is a simplified circuit diagram of the arpeggio-generating system of the present invention.

In FIG. 1, a microprocessor 10 is connected via communications bus 12 to another microprocessor (not shown) which reads the tabs and key switches of an organ 14. The microprocessor 10 in turn is connected to eight 8-bit addressable latches 16 and to a line decoder 18. The latches 16 generate ten millisecond pulses at the start of each tone to charge a condenser (not shown) in a gate circuit and initiate a percussive tone. The condensers (not shown) normally discharge slowly to give long sustaining tones. Additional latches (not shown) permit individual damping for each tone.

When an arpeggio is not desired and normal organ tones are to be played, the ten millisecond pulse is produced by a latch (not shown) corresponding to each newly depressed key. When the key is released a damp latch (not shown) is energized, giving a piano-like operation to the organ.

The microprocessor 10 receives communications from the organ 14 as to which notes are played, which variation and voice buttons and rhythm tabs are pressed, and the state of certain counters and rate pulses. In particular, one or more voice-related rhythmic patterns or variations are preselected by the user. The variations comprising VAR 2, 3, 4 determine the rate and the synchronization means by which the arpeggio is to be produced. Other tabs such as the preferred rhythm rate are also preselected. The user initiates a desired arpeggio simply by playing one note or a chord.

The notes comprising the played chord are chosen from the various octaves on the lower accompaniment manual, i.e., keyboard (not shown), of the organ 14. The keyboard has six octaves, i.e., five full octaves and a sixth (lowest) C note. The highest C note on the keyboard is in the fifth full octave, octave 5, while the lowest C note at the left end of the keyboard is in an octave all by itself, octave 0. The microprocessor 10 receives the notes played from the organ 14 via communications bus 12 and stores these notes and their corresponding notes in higher octaves in a memory block defined by registers R20 through R24 (see TABLE 1 at the end of the specification) in the random access memory of microprocessor 10. A portion of the random access memory of microprocessor 10, including registers R20–24 as well as other registers, is depicted by TABLE 1, which is discussed in more detail below.

Each register in the memory block R20–24 contains eight bits, as indicated by bits 0–7 (reading from right to left). However, only the six right-most bits, bits 0–5, are needed in the preferred embodiment. Binary zeroes are stored in the two left-most bits. The six right-most bits represent the six octaves of the lower keyboard (i.e., octave 0 through octave 5, from right to left). Accordingly, registers R20–24 can store up to a maximum of 26 notes—five notes in each of the five full octaves plus the low C note in octave 0 (the sixth octave).

In the preferred embodiment, the lowest note played first is the first note stored in memory block R20–24. Thereafter, the next lowest note played is stored, etc. A C♯ note is considered the lowest note within the octave and will always be the first note stored if it is played on the keyboard. A C note is the highest note within the octave and is always considered note n if it is played where n notes are played in all. Accordingly, all C♯ notes are listed first, if a C♯ is played. Then, all D notes are listed, if a D is played. Thereafter, all D♯ notes are listed, if a D♯ is played, etc. Finally, all C notes are listed, if a C is played.

The two following examples illustrate how notes are stored in memory block R20–24 of Table 1.

| | Example 1, Play C2, E3, G3, C3 | Example 2, Play C2, E3, G3, A3, B3, D4 | |
|---|---|---|---|
| R20 | 00111000(E) | 00110000(D) | Note 1 |
| R21 | 00111000(G) | 00111000(E) | Note 2 |
| R22 | 00111100(C) | 00111000(G) | Note 3 |
| R23 | 00000000 | 00111000(A) | Note 4 |
| R24 | 00000000 | 00111000(B) | Note 5 |

In example 1 (a simple major triad) , E3 (E note, octave 3) is stored in register R20, TABLE 1, by placing a binary one in bit 3. For purposes of performing the arpeggio, notes in higher octaves of the same nomenclature as the note played on the lower keyboard are also entered in the same register. For example, The E notes in octaves 4 and 5 are also stored in register R20 by entering a binary one in bits 4 and 5. Next, G3 (G note, octave 3) and G notes in octaves 4 and 5 are stored in register R21 in the same manner. Thereafter, C2 (note C, octave 2) and the corresponding C notes in octaves 3, 4, and 5 are stored in memory block R20–24 by entering a binary one in bits 2–5 of register R22.

Although Example 1 shows four notes played, only the lowest notes E3, G3, and C2 are entered in separate registers in memory block R20–R24. Notes C2 and C3 are considered the same note for storing purposes because if C2 is played, C3 will automatically be stored too. The presence of C3 is stored in bit 3 of register R22—as represented by a binary one. In addition, the C notes are always stored last in memory block R20–R24, even if a C note was the lowest note played, because the C note is the highest note in each octave as defined above. When progressing upward in frequency, the microprocessor 10 scans each column of bits (i.e., 0–5) in memory block R20–24 from right to left. Thus, in Example 1, note C2 is the first note encountered by microprocessor 10 when a search is initiated.

In Example 2 (a complex and dissonant chord) , the notes are stored in memory block R20–24 in a similar manner. First, D4 (D note, octave 4) and the D note in octave 5 are stored in register R20, Table 1, by entering a binary one in bits 4 and 5. Next E3 (E note, octave 3) and its corresponding notes in octaves 4 and 5 are stored in register R21 by entering a binary one in bits 3, 4 and 5. Similarly, G3, A3, and B3 (and their corresponding notes in octaves 4 and 5) are stored in registers R22, R23, and R24, respectively. In Example 2, C2 (C note, octave 2) is not stored in the memory block R20–24 because a maximum of five played notes may be entered and the C note is not among the five lowest notes in an octave. It should be understood that a chord must be quite dissonant (as in this example) in the preferred embodiment to omit a played note.

The selection of notes as a result of a desired chord being played is called octave priming and, except for the five note limitation, is performed by electronic circuits in previous organs. Octave priming is performed in the present invention by the execution of an algorithm in microprocessor 10 (see FIG. 4 and main program block 60 in FIG. 2). For Example 1 above, the value stored in register R22 is obtained by starting with byte 11110011 where a logic 0 (negative logic) indicates that C2 and C3 are being played. A mask set to a binary 1 (00000001) at block 61 is "anded"to byte 11110011. Thereafter, comparator 67 determines whether the resulting byte is equal to 00000000. If not, the binary 1 in the mask is shifted to the left at block 65 and block 63 is repeated. When the shifted mask becomes 00000100 at block 65, then "anding" the mask at block 63 results in a byte equal to 00000000. Subsequently, comparator 67 detects the zeros and microprocessor 10 executes block 69. There, the mask is complemented for a resultant 11111011 and incremented to 11111100. Then bits 6 and 7 of register R22 are set to 0 and the resultant number in register R22 (00111100) indicates that C5, C4, C3, C2 are available for the arpeggio because C2 was the lowest played C.

The microprocessor 10 receives data from the organ 14 via the communications bus 12 following an external interrupt signal received at input terminal 10*i* every 5.2 milliseconds. This data informs the microprocessor 10 which notes are played and which tabs and voice buttons are actuated. Receipt of such data is represented by block 19 in FIG. 2. The data received may not only represent actual keys played but also chord notes depending on a single key being played. A tab marked "one-finger" may be used to actuate this mode. Besides this data stored in registers R20–24, the arpeggio-generating system detects and records the exact position of the notes played with respect to the note C generally. The exact positions of the notes are stored in registers R10–14 on a descending basis as represented by a descending scale number ("DSN") value, i.e., the number of notes that the particular note is below C. Referring to Example 1, the DSN values for E3, G3, and C2 are 8, 5, 0, respectively. These values (8, 5, 0) are stored in the DSN memory area, as represented by registers TABLE 1, in the following manner. Of the notes played, the E3 note is the note farthest away from C. In fact, an E note is eight notes below a C on the musical scale. Therefore, a binary number 8 (1000) is entered in register R10. Similarly, a binary 5 (0101) and a binary 0 (0000) are entered in registers R11 and R12, respectively, indicating that the G2 note is five notes below note C o the musical scale and that C2 is zero notes below C. DSN values for Example 2 are determined similarly with values of 10 (1010), 8 (1000), 5 (0101), 3 (0011), and 1 (0001) corresponding to D, E, G, A, and B, respectively.

Figures 2, 4:
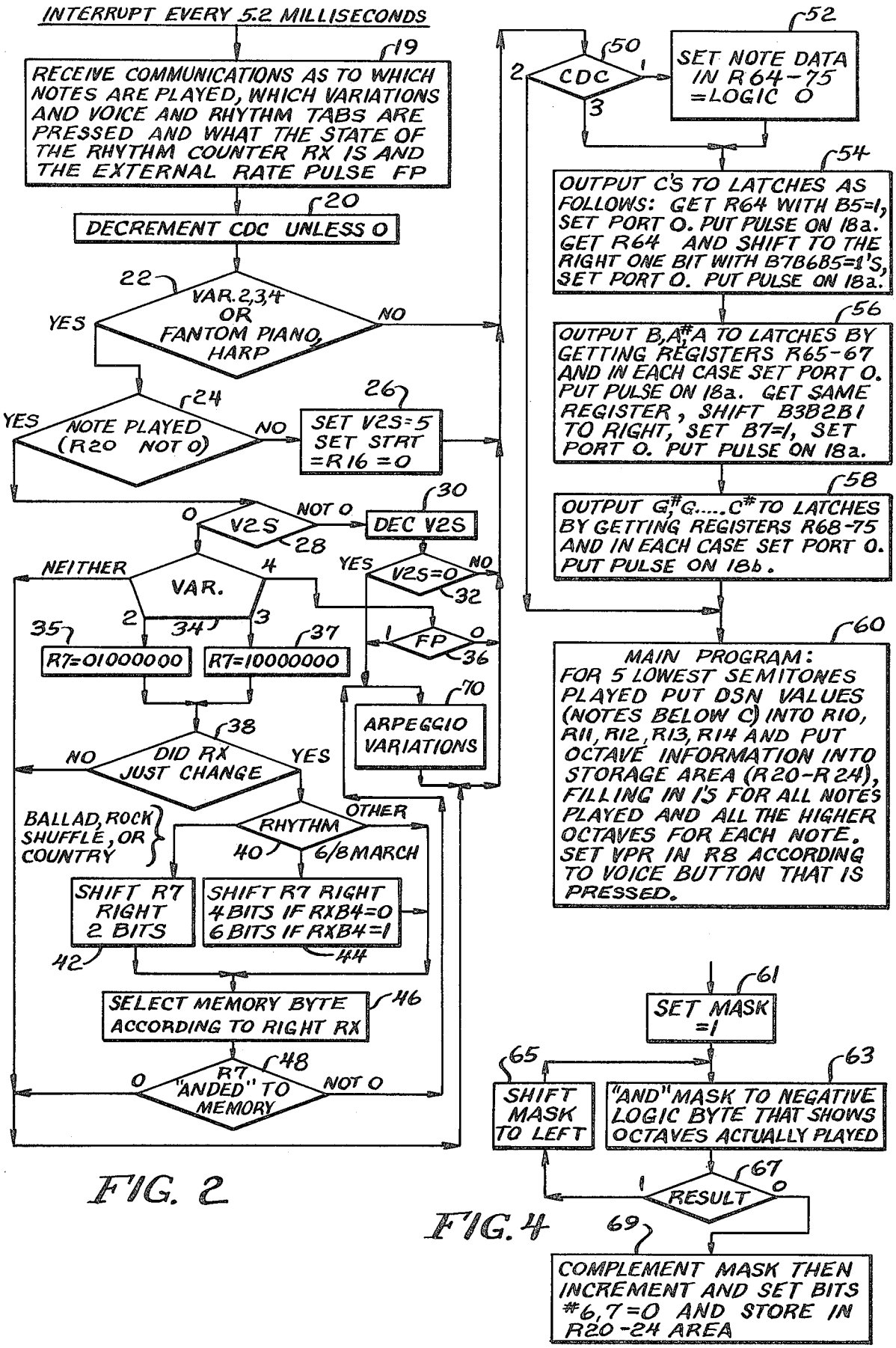
FIG. 2 is a simplified flow chart of the arpeggio-generating system illustrating the preferred embodiment of the present invention.
FIG. 4 is a flow chart illustrating an algorithm for octave priming.

As illustrated by block 60 in FIG. 2, microprocessor 10 also determines which voice button (not shown) has priority. More than on voice button (not shown) may be depressed to produce a combination of tone colors. However, the priority for the voice patterns is determined by whichever voice button is depressed first. The priority indicates which voice pattern is dominant. Register R8, bits 0–3, as represented by VPR (see TABLE 1) identifies voice has priority. In this preferred embodiment, a binary one (001) in register R8 represents a muted guitar voice (VPR=1); a binary two (010) represents a piano voice (VPR=2); a binary three (011) represents a banjo voice (VPR=3); a binary four (100) represents a guitar voice (VPR=4); a binary five (101) represents a harpsichord voice (VPR=5); a binary six (110) represents rinky tink voice (VPR=6); a binary seven (111) represents a fantom piano voice (VPR=7); a binary eight (1000) represents a fantom harp voice (VPR=8); and a binary zero (000) represents no voice.

During the time microprocessor 10 receives information from organ 14, as illustrated in block 19 (FIG. 2), the progress of a rhythm preselected by the user is entered in a rhythm counter RX as represented by register R1 in TABLE 1. For every one-forty-eighth of a measure, rhythm counter RX increases by 1, except when bits 0 and 1 of register R1 contain a binary two (10), in which case the rhythm counter RX increases by 2. Accordingly, rhythm counter RX progresses as follows: 0, 1, 2, 4, 5, 6, 8, 9, 10, 12, 13, 14, 16, 17, 18, 20, 21, 22, etc. This progression indicates that bits 2 and 3 count one-sixteenth notes within a quarter note, bits 4 and 5 count quarter notes within a measure, and bits 6 and 7 count measures up to four. The rate at which the one-forty-eighth notes are produced is determined by a tempo potentiometer (not shown) connected to another microprocessor (not shown) as described in the U.S. patent application entitled "Tempo Measurement, Display, and Control System for an Electronic Musical Instrument", U.S. Ser. No. 273,788, filed June 15, 1981. The microprocessor 10 also receives data for a one bit flag FP representing an external rate which is determined by an external rate potentiometer (not shown). This external rate is used only when the variations 4 button is pushed. When the variations 2 or variations 3 button is pushed the arpeggios are in synchonism with the rhythm-counter, but as explained below the arpeggio rate is twice as fast in variations 3 as in variations 2, and the rate is altered for certain rhythms. With no variation button pushed, the latches in FIG. 1 are used to produce accompaniment sequences of chords which are different for each rhythm (as described in the U.S. patent application entitled "Memory Condensation System for Rhythms and Sequences in an Electronic Musical Instrument", U.S. Ser. No. 275,032, filed June 18, 1981). However if a "fantom touch strip" is touched, and the "fantom harp or fantom piano" button is pushed, then even without pressing the variations buttons the arpeggios listed for VPR equals 7 or 8 are obtained. These occur at fixed rates as described below.

A two bit countdown flag, CDC, is stored in bits 0 and 1 of register R2, TABLE 1. Flag CDC is decremented by one from an initial binary three (11) after communications are completed between the microprocessor 10 and organ 14. When Flag CDC is decremented to 1, the latches 16 are set to zero by block 52 to end their ten millisecond pulses (which started when CDC was 3), thereby indicating the sounding of the corresponding tones. Flag CDC also triggers the damping latches (not shown).

Referring to FIG. 2, the decrementing of flag CDC is shown by block 20. Thereafter, microprocessor 10 determines at comparator 22 whether variations button 2, 3, or 4 is pushed, or the fantom touch strip is touched and the fantom piano or voice harp is pushed. If no tonal arpeggio or pattern has been selected by the variation or fantom buttons, the microprocessor 10 bypasses the arpeggio variation routine 70 and searches for the value stored in flag CDC at comparator 50. If CDC equals the latches are turned off in blocks 56, 58 and 60 to end any ten millisecond pulses. If, however, an arpeggio is selected, the microprocessor 10 determines whether a note is being played at comparator 24. If no note is being played, the starting note of the chord ("STRT") as represented by register R16, bits 0–2 (TABLE 1), is set to 0 at block 26. This represents note 0, octave 0 which is below any real note and assures that the arpeggio will start at the beginning. Also, a timer, V2S, is set to a binary five (101) at block 26 to delay the start of the arpeggio for twenty-six milliseconds after a note is played (the arpeggio begins one millisecond after the timer V2S has counted down to 0). This delay is implemented so that when a chord is played, the first note of the arpeggio will be properly selected even if the lowest note (which is usually the first note sounded) is played few milliseconds after the other notes in the chord. When timer V2S has been decremented from five to zero, the first note is sounded by going into the arpeggio routine, which is illustrated by block 70, regardless of the state of the rhythm counter RX or the external rate flag FP. Subsequent notes of the chord are controlled by rhythm counter RX or flag FP. Nevertheless, the first time interval is approximately correct because another microprocessor (not shown) synchronizes rhythm counter RX and flag FP with the playing of the first note. Thereafter, the microprocessor 10 examines the value stored in flag CDC at comparator 50.

If a note is detected as being played at comparator 24, then comparator 28 determines whether timer V2S has counted down to 0. If timer V2S does not equal 0, then block 30 decrements timer V2S by 1, and comparator 32 determines whether timer V2S is now equal to 0. If timer V2S still does not equal 0, then comparator 50 examines the value of flag CDC. If timer V2S does equal 0 at comparator 32, then the first note is sounded by execution of the arpeggio routine 70, as discussed below.

Referring to comparator 28, if timer V2S equals 0, then variations comparator 34 determines which arpeggio variation has been selected by depression of the variations button (not shown). If variations 4 is selected, comparator 36 checks the value of flag FP. If flag FP is equal to 1, then the arpeggio routine 70 is executed. If flag FP is equal to 0, then comparator 50 examines the value of flag CDC, as discussed below.

The synchronism of the arpeggio notes generated with the rhythm counter RX is more complicated for variations 2 (slow) and variations 3 (fast). In variations 2, notes at an eighth note rate are desired for most rhythms. But for the ballad, rock, shuffle and country rhythms, a twelfth note rate is desired. Further, for the six-eight march, a sixth note rate is desired. Variations 3 produces arpeggio notes at twice these rates.

The aforementioned rhythm rates are produced from an array of twelve bytes of data shown in TABLE 3 at the end of this specification. A mask is produced in register R7 where one of the bits is set to 0 or 1 depending upon whether variation 2 or 3 is selected and whether a special rhythm is selected. In either case, one of the vertical columns shown in TABLE 3 is implemented. Further, a binary one occurs in TABLE 3 at regular intervals throughout the incrementing of rhythm counter RX. Each vertical step represents a one-forty-eighth note. Accordingly, the proper timing in each column is obtained. For example, bit 7 is used for most rhythms in variation 3 where a binary one occurs every three one-forty-eighth notes to produce one-sixteenth notes. The last four bits for rhythm counter RX (bits 0–3) are sufficient to control all cases except when one-sixth notes are required by the six-eight march. Then, two columns have to be implemented, one for bit 4 of rhythm counter RX equalling 0 and the other for bit 4 of rhythm counter RX equalling 1. By using these columns alternately, the sixth notes repeat every eight one-forty-eighth notes. The memory block at VA2P as represented by TABLE 3 actually contains sixteen bytes. However, as previously explained, the rhythm counter RX always skips the locations for right RX equal 3, 7, 11, 15.

Referring to variations comparator 34, if variation 2 has been selected, then a binary one is stored in register R7, bit 6 (TABLE 1), by block 35. If variations 3 has been selected, then a binary one is stored in register R7, bit 7, by block 37. Subsequently, block 38 examines whether the value stored in rhythm counter RX has changed. If RX has not changed, microprocessor 10 executes the logic initiated by comparator 50. If RX has changed, then rhythm comparator 40 determines which rhythm has been selected. If the ballad, rock, shuffle, or country rhythm has been selected, block 42 shifts the contents in register R7 to the right two bits before the microprocessor 10 proceeds to block 46. If the six-eight march is selected, the contents of register R6 are shifted in block 44 to the right four bits if RX, bit 4, is equal to 0 and to the right six bits if RX, bit 4, is equal to 1. The purpose of shifting the contents of register R7 to the right is to select the different pairs of columns in TABLE 3. Then, the microprocessor 10 proceeds to block 46. If any other rhythm is detected at rhythm comparator 40, microprocessor 10 proceeds directly to block 46. There, one of the twelve memory bytes in TABLE 3 is selected according to the value of the last four bits RX (bits 0–3). Subsequently, the selected memory byte from TABLE 3 is "anded" to the contents of register R7 at block 48. If the result is 0, the microprocessor 10 advances to comparator 50. If the result is not 0, the arpeggio routine 70 is executed before the microprocessor 10 advances to comparator 50. The arpeggio routine 70 places a note from the arpeggio sequence, or several notes if a chord is desired, into random access memory registers R64–75 (see TABLE 1).

Referring to comparator 50 in FIG. 2, flag CDC is initially preset to a binary 3 (11) during most executions of routine 70. As a result, the latch-setting routines 54, 56 and 58 start the trigger pulses on the outputs of the latches 16 which are connected to the percussive gates (not shown) using all the data in memory block represented by registers R64–75. Ten milliseconds later when CDC becomes 1, all the data in registers R64–75 is set by block 52 to a "logic 0" (actually 1's because negative logic is used), and the latches 16 are reset by routines 54, 56 and 58 so that all the trigger pulses last ten milliseconds on the latches to operate the gate circuits (not shown) and sound the arpeggio notes. It should be noted that bits 5–7 in registers R64–75 are fixed bits (except register R64, bit 5) which address the latches. These bits are refreshed when the contents of flag CDC becomes 1 by starting with 01111111 and decrementing by 00100000 as each byte of data is stored in the memory block R64–75. As a result, the desired logic 0 is given for all notes, and the desired fixed bits are stored.

Referring to FIG. 1, a strobe pulse from output terminal **10*j* is received by decoder 18 at input terminal 18*h* every time microprocessor 10 generates an output at terminals 10*k*, 10*l* and 10*m*. The strobe pulse is directed to one of several strobe output terminals 18*a–d* of decoder 18** according to the bits at 1O*k*, **10*l* and 10*m*. Output terminals 18*a* and 18*b* are connected to the eight latch packages 16 for generating the beginning and the end of a 10 millisecond pulse which initiates the percussive tone for each selected note of the arpeggio. Output terminals 18*c* and 18*d*** are connected to a similar set of latches (not shown) for damping purposes.

The eight output terminals **16*f–m* of each latch 16 are connected to percussive gates (not shown) and remain in a high or low state until a negative strobe pulse is received at the enable input terminal 16*e*. Thereafter, the data on the input terminal 16*d* is transferred to one of eight output terminals 16*f–m* according to a previously set address stored at address terminals 16*a–c***.

As represented by blocks 54 and 56 (FIG. 2), output terminal **18*a* sets the three left-most latch packages 16 (FIG. 1). The data in R64–R67 (TABLE 1) is transferred to the C, B, A#, and A output terminals of the latch packages 16. However, in each case, data pertaining to octaves 5, 3 and 1 is outputted first. Then the data is shifted to the right and data pertaining to octaves 4, 2, and 0** is outputted.

The five right-most latch outputs can be set simultaneously by applying an appropriate strobe pulse from line decoder 18 simultaneously to the enable input terminal **16*e* of the five right-most latch packages 16. The logic illustrated by block 58 first outputs the data in register R68 to port 0, bits 0–7. Since the microprocessor 10 inverts all the data at its output terminals, the binary 1 in bits 7, 6 and 5** of register R68 change to a binary 0 when outputted to address terminals 16*a–c* of the five right-most latch packages. Accordingly, output terminal 16*f* is actuated in these latch packages. Subsequently, output terminals 10*k–m* are set to a binary one (001), thereby transmitting the strobe pulse to output terminal 18*b* and transferring all the data to all the G# output terminals in the five right-most latches 16.

This data is an inverted version of the contents of register R68, bits 0–4. Accordingly, it is positive logic. As a result, ten millisecond positive pulses are started on selected output terminals 16*f* representing the G# note. Then, the data in register R69 is transferred to port 0, and output terminals 10*k–m* are again set to actuate output terminal 18*b*. This time, the address terminals 16*a–c* receive the complement of 110, i.e., 001. Accordingly, all the desired G notes are selected. By repeating this procedure six more times with the appropriate addresses applied to address terminals 16*a–c*, the F#, F, E, D#, D and C# notes are set.

Although not shown in FIG. 2, the three latch setting blocks 54, 56, and 58 trigger signals from output terminals 18*c–d* for damping. The latches controlled by these registers are set to 1 if no damping is required and it is intended that the tones have a long decay. The latches are set to 0 if damping is required so that the tones decay quickly. This is similar to releasing played keys on a piano and not using the sustaining pedal.

Figure 3A:
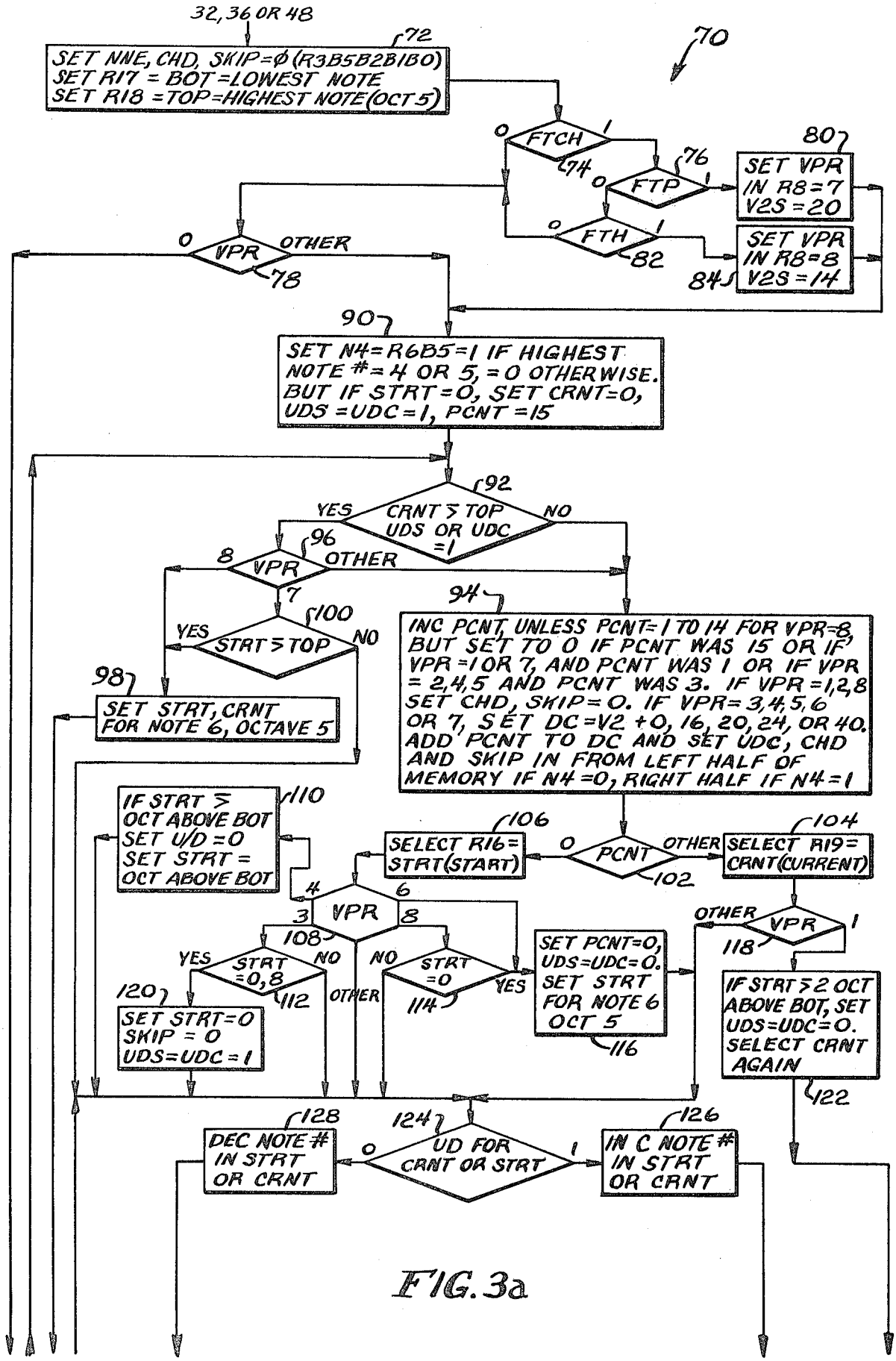

FIGS. 3*a* and 3*b* together disclose the overall flow diagram for the arpeggios routine 70. This routine 70 accesses data from the R20–24 storage area as illustrated by Table 1, transfers that data to the R64–75 storage area, and sets flag CDC to equal a binary three (11). As a result the corresponding latches are set, except if VPR equals 0 (no voices) or if STRT or the next note within a group (CRNT) equals 10000110 (note 6, octave 5), which is a flag to produce silence at the end of a fantom touch piano or harp sequence. If no notes are played, i.e., register R20 contains a 0, then arpeggio routine 70 is bypassed as shown in FIG. 2.

Upon entering the arpeggio routine 70 (see FIGS. 3*a* and 3*b*), the following flags in register R3 are preset to zero by block 72: the next note extreme ("NNE") flag; search for another note ("CHD") flag, and the number of skipped notes ("SKIP") flag. The NNE flag is stored in register R3, bit 5. The CHD flag is stored in register R3, bit 2. If CHD were equal to 1 for a particular note, then another note would be searched for and stored in memory area R64–75. The SKIP flag is a two bit number which indicates how many notes are to be skipped when searching for the next note to be outputted. In the preferred embodiment, the SKIP flag skips up to three notes between any adjacent chord notes and is stored in bits 0 and 1 of register R3 in TABLE 1. At the end of a group of notes there can be considerably more gap because SKIP for the STRT note of a new group refers to the number of notes skipped when relating it to the STRT note of the previous group and not the last CRNT note of the previous group. Block 72 determines the lowest note (BOT) and the highest available note (TOP) played by examining the memory area R20–R24. In the preferred embodiment, BOT is stored in register R17. Bits 0–2 of BOT (see TABLE 1) give the note number which is 1 to 5 according to its position in memory R10–14 or R20–24 where the notes are listed in order of their frequency with DSN decreasing in value. As mentioned previously, note C# is considered the lowest note and is note 1 of the chord if it has been played. Note C is the highest note and is note n of the chord if it is being played and if n notes in all are being played. The octave number of BOT is indicated by entering a 1 in only one of the bits 3 through 7 of register R17. However, the lowest C (octave 0) would have a binary 0 entered in all bits 3–7. The advantage of this format is that the position of one note compared to another note (i.e., whether the first note is lower than, equal to, or higher than the second note) can be determined by comparing the corresponding binary numbers. Data corresponding to the notes representing STRT, CRNT and TOP is similarly stored in registers R16, R19, and R18, respectively. However, it is understood that other formats may be utilized with the present invention. It should be understood that STRT and CRNT sometimes refer to nonexistent notes 0 or 6 as a temporary expedient.

With reference to FIG. 3*a*, once the binary data has been stored in the aforementioned registers R3 and R16–19, comparator 74 determines whether the touch strip (not shown) is being contacted (i.e., whether the touch strip mode is being selected) by the user. The touch strip provides two additional arpeggio patterns for piano and harp voices. If the user is not contacting the touch strip, then the value of VPR in register R8 is determined at comparator 78. If the user touches the touch strip, then comparator 76 determines if the fantom piano button (not shown) has been pressed (as represented by a binary one being detected). If the fantom piano button has been pressed, block 80 sets VPR in register R8 equal to a binary seven and timer V2S equal to a binary twenty before block 90 is executed. If the fantom piano button has not been pressed, then comparator 82 determines if the fantom harp button has been pressed. If pressed, then block 84 sets VPR in register R8 equal to a binary eight and timer V2S equal to a binary fourteen before block 90 is executed. If the fantom harp button is not pressed at comparator 82, then the value of VPR is checked at comparator 78.

It should be noted that by setting timer V2S, the rates for fantom harp and fantom piano are fixed since the next note of the arpeggio being generated will not be produced until timer V2S (which is decremented every 5.2 ms) decrements to 0 (see blocks 30, 32 in FIG. 2). Also, there is no synchronization of the arpeggio notes to the rhythm rate or external rate.

If VPR equals 0 at comparator 78, indicating that no voice button is depressed, then the rest of the arpeggio routine 70 is bypassed except that STRT in register R16 is set to 0 at block 188 (FIG. 3*b*) so that any future arpeggio pattern will start at the beginning of the played chord.

If VPR does not equal 0 at comparator 78 or if either comparator 76 or 82 indicates that the fantom piano button (not shown) or the fantom harp button (not shown) is depressed (binary one), then the execution of block 90 performs the following logical steps. A flag N4, located at register R6, bit 5, is set to 1 if the played chord includes 4 or 5 notes. Otherwise, N4 is set to 0. The same note played in two or more octaves constitutes only one note for this test. Also, if STRT equals 0, then block 90 sets CRNT equal to 0, up-down STRT (UDS) flag equal to 1, up-down CRNT (UDC) flag equal to 1, and the count of notes within each arpeggio group (PCNT) equal to 15 so the sequence will be ready to start upward. The UDS and UDC flags indicate whether the search for a STRT or a CRNT note moves up or down in pitch from the previous STRT or CRNT note (hereinafter, UD includes both UDS and UDC). A binary 1 in the UD flags indicates that the search is to move up in frequency, and a binary zero in the UD flags indicates that the search is to move down in frequency. Thereafter, comparator 92 examines the CRNT note to determine if it is equal to or greater than the TOP note. Also, comparator 92 determines whether the selected UD flag is equal to 1. If the CRNT note is greater than or equal to the TOP note and the selected UD flag is equal to 1, some ending conditions are tested for at blocks 96 and 100, as discussed below. If the CRNT note is lower than the TOP note or if the selected UD flag is not equal to 1, then block 94 increments PCNT unless certain conditions are present. If the maximum size of the group of notes is sixteen, then PCNT is always set to zero if its previous value was 15. For groups of four notes such as used for the piano, guitar or harpsichord voices (i.e., when VPR equals 2, 4 or 5), PCNT is set to 0 if the previous value was 3. For groups of two notes such as used for the muted guitar or fantom piano (i.e., when VPR equals 1 or 7), PCNT is set to 0 if the previous value was 1. This is accomplished automatically by setting bits 3 and 2 of PCNT to 0 for VPR equals 2, 4, or 5 and by also setting bit 1 of PCNT to 0 for VPR equals 1 or 7, as illustrated in block 94, FIG. 3*a*.

Figure 5:
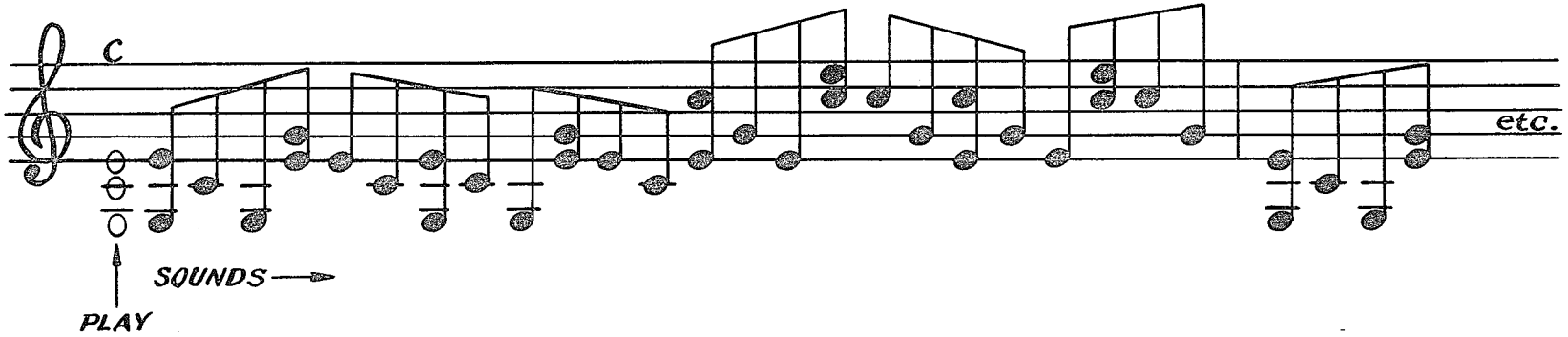
FIG. 5 is a musical example of a three note banjo arpeggio resulting from a three note chord being played.

The four bits comprising the CHD, SKIP, and UDC flags are stored in memory for each note of a chord for all voices for which these effects are desired. The 42 bytes shown in TABLE 2 is all the data needed for VPR equals 3, 4, 5, 6, and 7. Separate data is illustrated in TABLE 2 for the case of less than four notes within an octave and for the case of four or five notes. TABLE 2 illustrates the data used to obtain the desired response to the three note chords shown in FIGS. 5 and The only difference between the three and four note cases are the values for SKIP.

The values for the UDC flag in TABLE 2 are used to override the effect of any previous initialization due to STRT being equal to 0 in block 90 (FIG. 3*a*) or any previous effect of blocks 174, 158, 162, 116, and 120. The UD flags (if VPR equals 1, 2 or 8) are controlled by blocks 174, 158, 162, 116, and 120. Block 94 (FIG. 3*a*) shows how the data is extracted from TABLE 2. If VPR is equal to 3, 4, 5, 6 or 7, data counter DC is set to V2 +0, V2 +16, V2 +20, V2 +24, or V2 +40, respectively. Next, PCNT is added to data counter DC and the appropriate UDC, CHD, and SKIP values are selected. The left or right half of the memory byte selected by DC is used depending on whether N4 equals 0 or 1 (see TABLE 1). If VPR is equal to 1, 2 or 8, SKIP and CHD are set to 0.

Whenever a note is found by block 142, block 150 determines whether SKIP is 0. If SKIP is 0, the note is out-putted by branching to block 176. Otherwise, SKIP is decremented by block 156 and another note is searched for by returning to comparator 124 and checking the appropriate UD flag. The selected UD flag is not changed so the search continues in the same direction. Therefore, a number of notes will be skipped according to the original value of SKIP, unless TOP or BOT is encountered, in which case that note will be sounded and the UD flag will be changed.

The CHD flag is tested by comparator 178 after block 182 stores note in the R64–75 storage area and block 180 sets CDC equal to 3. If the CHD flag is equal to 1, as determined by block 178, the routine branches to block 92. PCNT is incremented and a new CHD flag is obtained in block 94. Accordingly, n notes could be included in a chord by having n-1 chord flags in succession in TABLE 2. A new value of SKIP is also obtained so the chord can be opened up in any desired manner as long as not more than three available notes are skipped between any adjacent chord notes.

In one special case, TABLE 2 is not consulted for a chord. If VPR is equal to 7 (fantom piano variation) and if the second note of a two note group (i.e., the top note of a chord) has reached TOP, then the CHD flag is set to 1 by block 60 so that a transfer back to block 92 is enabled via blocks 158, 176, 182, 180 and 178. Since CRNT is equal to TOP and UDC is equal to 1 in this special case, block 92 (FIG. 3*a*) executes comparator 96. When VPR is equal to 7 at comparator 96, comparator 100 determines whether STRT is greater than or equal to TOP. If it is, then STRT and CRNT are set for note 6, octave 5 before microprocessor 10 proceeds to comparator 50 (FIG. 2). If STRT is less than TOP, the program branches back to comparator 124 with STRT being selected. Since the UDS flag is equal to 1 at comparator 124, STRT is incremented by block 126 to the next available note. CHD remains at 1 since it is not reset by block 94 so that all the available notes in between are filled, including the TOP note for the second time. Finally, STRT is greater than TOP, and comparator 100 branches to comparator 50 (FIG. 2) to terminate the sequence without any note being sounded until the following conditions occur STRT is set to zero again by block 26 in FIG. 2 if the notes are released or by block 188 in FIG. 3*b* if VPR becomes 0 by the touch strip (not shown) being released.

A search is usually made for the next available note to be sounded among the octave primed notes listed in memory storage R20–24, Table 1. The search begins with the previous STRT note where PCNT is 0 indicating that the note to be searched for is the first note in an arpeggio group, or with the previous CRNT note where PCNT is not 0.

Initially CRNT and STRT are preset to 0 (note 0, octave 0) by blocks 26 and 90. PCNT is set to 15 by block 90 and is immediately incremented to 0 at block 94. In addition, the UDS and UDC flags are set to 1 indicating the search is upward regardless of whether the search starts with the STRT or CRNT note. The value of PCNT is then examined at comparator 102. When PCNT equals 0, register R16 (containing STRT) is selected at block 106. Accordingly, the arpeggio begins with the STRT note, and not the CRNT note. Next, comparator 108 examines the value of VPR. If VPR equals 2 (piano voice), microprocessor 10 moves to comparator 124. If VPR had equalled 3, 4, 6 or 8 at comparator 108, a number of steps would have been taken prior to microprocessor 10 executing comparator 124. If VPR equals 4, block 110 determines whether STRT is greater than or equal to the octave above BOT before proceeding to comparator 124. If so, then the UD flags are set to 0 and STRT is set equal to the octave above BOT. If VPR equals 3 at comparator 108, then comparator 112 determines whether STRT equals 0 or 8. If STRT equals 0 or 8, then STRT and SKIP are set equal to 0 by block 120. In addition, the UD flags are set equal to 1. Then, microprocessor 10 proceeds to comparator 124. If VPR equals 6, block 116 sets PCNT and the UD flags to 0. In addition, STRT is set for note 6, octave 5 before the execution of comparator 124. If VPR equals 8, comparator 114 determines whether STRT had been set to 0. If so, then block 116 is executed as previously described. If not, then microprocessor 10 proceeds to comparator 124.

As mentioned previously, the UD flags were initialized to 1 at block 90, which is detected by comparator 124. Next, the note number in STRT is incremented to one by block 126 before microprocessor 10 proceeds to block 136 in FIG. 3B. Referring to block 102, later when PCNT is not equal to 0, register R19 (containing CRNT) is selected at block 104. Accordingly, the arpeggio continues with the CRNT note and not the STRT note. Next, comparator 118 examines the value of VPR. If VPR equals 2 (piano voice), microprocessor 10 executes comparator 124. If VPR had been equal to 1 (muted guitar), then microprocessor 10 would have proceeded to block 122 to determine whether STRT was greater than or equal to two octaves above the BOT note. In addition, the UD flags would be set equal to 0 and CRNT would be selected again. Thereafter, microprocessor 10 would proceed to block 176, as discussed below.

When comparator 124 finds that in the UDS flag is set to 1, block 126 is executed. STRT was initially set to 0 (note 0, octave 0, a non-existent note lower than the lowest possible note on the lower keyboard) by block 26 (see FIG. 2). Therefore, when STRT is incremented by block 126 to 1 (note 1, octave 0), it will be a real note if low C is being played. Next, block 136 is executed. If a 1 is stored in STRT, note number 6 or 7 is not found at block 136. Consequently, micro-processor 10 branches to accumulator 134. In the cases where a 6 or 7 is detected by block 136, comparator 140 detects whether the note is in octave 5. If not, then in block 154 STRT is set to note number 1 in the next higher octave before microprocessor 10 branches to accumulator 134. If the note is in octave 5, then microprocessor 10 proceeds to block 176, as discussed below.

At accumulator 134, TOP is substracted from STRT. The result is a negative number in this case, thereby causing microprocessor 10 to determine in block 142 whether a note found is in storage area R20–24. If the result had been positive, then microprocessor 10 would have executed block 174, as discussed below. When the result is zero, the TOP note has been reached, as discussed below.

In the present example, block 142 determines that the note number is 1 and examines register R20. Block 142 tests for a 1 in bit 0 (octave number 0) and finds a 1 there for the C0 note (assuming the low-C note is played). As a result, the search is complete and microprocessor 10 proceeds to comparator 150. If no note had been found, then microprocessor 10 would have returned to comparator 124 (FIG. 3*a*). In the present example (i.e., the start of a piano arpeggio), comparator 150 determines the value of SKIP to be 0, and the microprocessor 10 branches to block 176 where CRNT is set equal to STRT. This is the only operation performed at block 176 for th piano voice case where VPR equals 2. If VPR was equal to 3 and if STRT was greater than BOT, block 176 would set STRT equal to 8. Thereafter, block 176 would insert C0 (low C) into register R64. The storage of notes in the register R64–R75 area, including the special low C case, is discussed below.

In most cases at block 142, no note is found in the memory storage area R20–24. Accordingly, the microprocessor 10 returns to block 124 and identifies that UDS is equal to 1. Accordingly, the previously discussed steps illustrated in block 124 are repeated, thereby incrementing the note number and searching the storage area R20–24 for that note. Upon repeating these steps, there still may be no note found in storage area R20–24. If no note is found, the steps are repeated again. When the note number for STRT is incremented to 6 at block 126 (FIG. 3*a*), comparator 136 proceeds to comparator 140 to determine whether the octave number has reached 5. In cases where the octave is not 5, block 154 changes the note number back to 1 and increments the octave number before microprocessor 10 moves to block 134 and continues the search for the next note in the arpeggio group.

For example, if the notes G3, C3, and E4 are played, the search for the first note would continue until STRT has been incremented to 00100010 (octave 3, note 2) by block 126. In this case, the G notes are represented in register R21 by 00111000. Bits 0–2 in STRT are equal to 010 causing the block 142 to find register R21 for note 2. Then STRT is temporarily shifted right 2 bits with bit 0 being set to 0 to get 00001000. Thereafter, R21 is "ANDED" to this modified STRT. The non-zero result shows the presence of G3 in register R21 and the search would stop with G3 being sounded as described below.

With STRT equal to 00100010 (i.e., note 2 in octave 3 is G3) and that note having been found in block 142, the program is directed by SKIP comparator 150 to block 176, which sets CRNT equal STRT (assuming STRT was selected). It is necessary to have G3 in both CRNT and STRT because during the search for the next note after G3 that next note will be put in CRNT and sounded. However, the STRT register continues to contain the note G3. When it is time for a new chord group to be sounded, PCNT will again be 0, and STRT will be selected (as opposed to CRNT) and incremented to the next note so that the first note of the new chord group will be sounded. Therefore, the note sounded in block 182 is always the one in CRNT.

For a note to sound, the corresponding DSN value must be found in the R10–R14 area (specifically Rll for note number 2). This is accomplished by using the note number in CRNT as a pointer to one of the registers R10–R14. Since DSN is the number of notes below C, the proper location in the memory block registers R64–75 is found by setting the DC data counter to R64 plus DSN at block 182. The note is inserted into this memory location by shifting CRNT to the right three bits, complementing, and "anding" to the memory byte pointed to by DC. The shifting causes the octaves of CRNT to correspond to the octaves in the R64–75 memory area. Complementing causes a zero to occur in the proper octave. Therefore, the proper bit in the R64–75 memory area is set to 0 according to the desired note. For example, if the CRNT note represents G3, i.e. 00100010 (note 2, octave 3), the register Rll (for note number 2) will have a DSN value equal to 5. Therefore, the memory byte to be affected will be R64+5 which equals R69. CRNT shifted to the right three bits and complemented is 11111011 and "anding" to R69 causes the G3 bit to be set to 0 (logic 1) which will be sounded in block 58, FIG. 2. Low C is a special case. If bits 3–7 of CRNT are 0 (which means octave 0), 11011111 is "anded" to memory instead, thereby setting bit 5 of register R64 to 0.

Referring to block 124 in FIG. 3*a*, when the UDC or UDS flag is 0, a downward search for the next note to be sounded is implemented. Accordingly, block 128 decrements STRT when PCNT is 0 at block 102 or otherwise decrements CRNT. If note number 0 is found at comparator 130 and if octave number 0 is found at comparator 138, then the overflow routine in block 174 is executed, as discussed below. STRT is never decremented below 0 by execution of block 128 (FIG. 3*a*) because whenever STRT is set to 0 for initialization, the UDS and UDC flags are set to 1. Accordingly, comparator 102 causes the note number to be incremented in block 126, rather than decremented. In the other cases, the note number for STRT or CRNT will not be 0 when the 0 in the UDS or UDC flags trigger block 128 in FIG. 3*a*. Assuming that STRT has been selected, its note number is decremented by block 128. Thereafter, comparator 130 determines whether the note number for STRT is 0. If the note number is 0, then comparator 138 determines whether the octave number is 0. If so, then the overflow routine in block 174 is executed in order to set UD flags back to one. If the octave number is not 0 at block 138, then the octave number is decremented and the note number is set to 5 at block 144. Thereafter (and also in the case where the note number is not 0 at block 130), comparator 146 examines the value of VPR. Unless VPR is equal to 8, block 132 is exeouted next. In the case where VPR is 8 (fantom harp), comparator 148 detects whether STRT is active and, if so, executes block 132. When CRNT is active instead, block 164 determines whether CRNT is two octaves below STRT. If not, block 132 is executed. If CRNT is two octaves below STRT, PCNT is set to 0 and STRT is selected at block 172. Then, microprocessor 10 returns to comparator 124.

Execution of block 132 determines whether the BOT note has been reached by subtracting BOT from STRT (or CRNT depending on which register has been selected). When BOT has been reached, i.e., STRT minus BOT is equal to zero, comparator 152 is executed. If BOT has not been reached, block 142 is executed. Also, if accumulator 132 registers a negative number, the overflow routine at block 174 is executed.

If VPR is equal to 2 (piano voice) and the UD's are zero, then each group of four notes is a downward progression with each group of four starting at the next lower available note than the start of the previous group. When the fourth note of a group of four reaches the lower limit, the pattern continues as if nothing had happened until four notes later when CRNT goes one note lower than BOT and the negative output from block 132 (or the positive output from block 134 when testing for TOP in an upward progression) is applied to the overflow routine performed at block 174.

When the notes being played are suddenly changed, thereby changing TOP or BOT, CRNT or STRT may suddenly be outside the note range defined by BOT and TOP. Whenever this occurs, the overflow routine in block 174 is executed. For example, if D2, G2, and B2 are played and the upward progression has already reached G5, the next note would normally be equal to TOP (B5). If B2 is released before B5 is sounded, then TOP becomes note 2, octave 5 (G5). CRNT will increment to note 3, octave 5, and block 134 will branch to the block 174 overflow routine. Block 174 changes the UD flags but also changes STRT (or CRNT) to TOP if the UDS (or UDC) flag is 1 or to BOT if the UDS (or UDC) flag is 0. The search then continues down from TOP or up from BOT.

Typically, execution of block 174 causes the TOP or BOT note to sound by branching to block 176 via block 170. For the piano voice variation, the BOT or TOP note has sounded before entering block 174. In order to avoid repetition, the next-to-last note of the arpeggio group is sounded to produce a more desirable musical effect by branching back to comparator 124 (FIG. 3*a*) via blocks 168 and 166 (FIG. 3*b*) with the UD flags reversed, thereby assuring that the previous note will be found. The NNE flag is set to 1 at block 166. This causes TOP or BOT to be sounded again after the next-to-last note has sounded.

Sometimes the next note extreme cannot be found because TOP and BOT are the same note. This situation occurs in the upward movement of an arpeggio when the only note played is in octave 5 on the lower keyboard. In that case, comparator 140 proceeds to overflow block 174. The UD flags are changed, and the NNE flag is determined to be 1 by block 170. As a result, an endless loop is avoided, and the microprocessor 10 branches to block 178 via blocks 176, 182, which causes the one note to be repeated.

Where the NNE flag has been set and the next-to-last note has been repeated by execution of block 182 (FIG. 3*b*), CDC is set equal to three (11) by block 180, and block 178 determines that the CHD flag has a 0 stored therein. Accordingly, the NNE flag is determined to be 1 by comparator 184. Depending on the state of the UDS flag, as detected by comparator 186, STRT is either set at a value above TOP (when UDS is equal to 0) by block 190 or below BOT (when UDS is equal to 1) by block 188. Also, PCNT is set to 15 and the two UD flags are set to 0 by block 190 if the previous four note group ended prematurely because of a last minute change in TOP. Otherwise, if the UDS flag is equal to 1, PCNT is set in the initializing procedure at block 90 (FIG. 3*a*).

The NNE flag is reset at block 72 when it is time to sound the next note, but the conditions are already set up for a TOP or BOT note by block 188 or 190 in FIG. 3*b*. The TOP note represents an upward movement despite the fact that the U/D flags are set up for a subsequent downward movement. Similarly, the BOT note represents a downward movement even though the U/D flags are already set up for a subsequent upward movement. Accordingly, there is always a five note trill at the top and bottom of the piano note pattern.

For voice variations other than the piano, additional arpeggio patterns are obtained by implementing the CHD and SKIP flags, and by utilizing the UDC flag to control the search. When the CHD flag equals 1 at block 178 (FIG. 3*b*), another note will be searched for and put into the R64–75 storage area (see TABLE 1). If CHD equals 1 for the second note, a third note will be searched for, etc. The two or more notes will be outputted practically simultaneously by the latch-setting routine as illustrated in FIG. 2 by blocks 54, 56 and 58, as previously described.

The fantom piano and harp sequences (VPR equals 7 and 8, respectively) are the only sequences which have definite ends to them. Definite ends are provided by setting STRT and CRNT equal to 10000110 (note 6, octave 5) at block 98. This value is higher than any value that TOP might have or change to if legato notes are played after the end. Therefore, comparator 100 continues to branch to block 98. The decay of the last notes and subsequent silence continues until no keys are played (see block 26, FIG. 2) or other times that STRT is set to 0 for reinitialization of the sequence.

The following are deviations of the arpeggio system described above. When VPR equals 1 (muted guitar), CRNT is selected every other time because PCNT alternates between 0 and 1. When CRNT is selected, the incrementing procedure is bypassed and a repeated note occurs because CRNT has been set equal to STRT in the previous block 176 routine. When a note two octaves above BOT is being repeated, the UD's are set to 0. This limits the upward progression to two octaves. The CHANGE UD blocks 162 and 174 reverse the direction in the other cases.

When VPR equals 3 (banjo), SKIP equals 1 or 2 for the very first note as shown on TABLE 2 at V2 where PCNT equals 0 and STRT is selected. These values are selected so that after twelve beats (sixteen notes counting a chord as two notes) STRT is incremented to the correct value (see FIG. 5). STRT starts at G2 but at the beginning of the fourth group of four notes advances to E3 by skipping one note, C2. At that time, STRT still equals BOT. But then, block 176 creates a special STRT flag equal to 8 (a nonexistent note number 0, octave 1). This flag lasts for twenty-four beats, whereupon it starts over. At that time, PCNT is set to 0 again, VPR is equal to 3, and STRT is equal to 8. Block 120 sets the STRT and SKIP flags to 0, thereby causing comparator 124 to branch to block 126 where STRT is incremented until BOT is reached. Also the UD flags are set to 1 at block 120.

Figure 6:
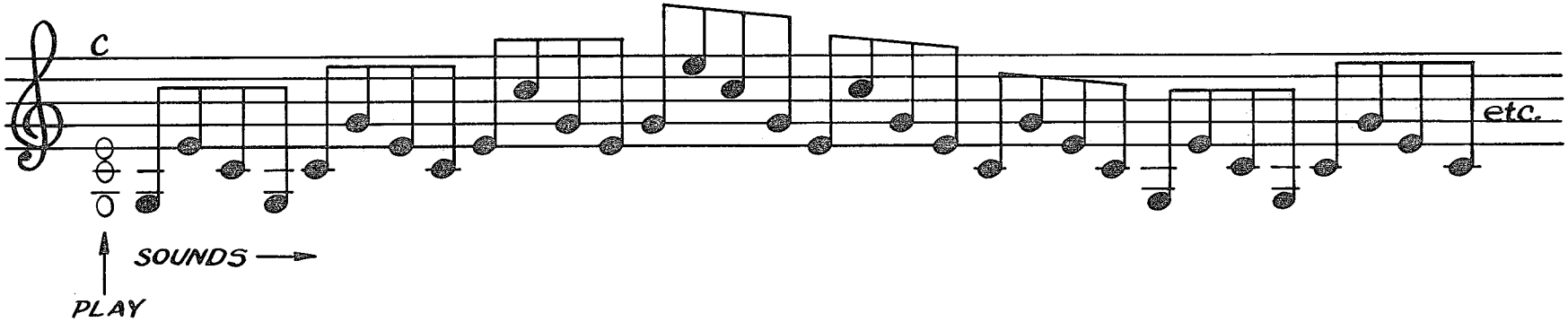
FIG. 6 is a musical example of a three note guitar arpeggio resulting from a three note chord being played.

If VPR equals 4 (guitar), each four note group of the arpeggio sequence starts 1 note higher than the previous one until a group that is an octave higher has been selected and sounded (see FIG. 6). Then, the VPR equal 4 output of block 108 causes the UD flags to be set to 0 at block 110, causing each group to start one note lower than the previous group. If BOT suddenly decreases by playing a low note, STRT is immediately adjusted to be not more than 1 octave above BOT. When STRT reaches BOT again, one of the CHANGE UD routines causes STRT to progress upwards again. These CHANGE UD routines also handle the UD progression of the VPR equal to 5 harpsichord sequence.

For VPR equal to 6 or 8 (rinky tink or fantom harp, respectively), the patterns start at TOP by setting STRT for note 6, octave 5 which is a nonexistent note above TOP. In addition the UD flags are set to 0. This occurs for VPR equal to 8 in response to the initialization of STRT flag equal to 0 and at the start of each 16-note group for VPR equal to 6. The arpeggio sequence sounded for VPR equal to 8 goes down according to a first sequence and up according to another sequence when block 158 sets UDC and UDS to 1.

Although the invention has been described in terms of a preferred embodiment, it will be obvious to those skilled in the art that many alterations and modifications may be made without departing from the invention. Accordingly, it is intended that all such alterations and modifications be included within the spirit and scope of the invention as defined by the appended claims.

TABLE 1

| REGISTER | BIT 7 | BIT 6 | BIT 5 | BIT 4 | BIT 3 | BIT 2 | BIT 1 | BIT 0 | |
|---|---|---|---|---|---|---|---|---|---|
| R3 | | | NNE | | | CHD | SKIP | | |
| R6 | UDS | UDC | N4 | | | PCNT | | | |
| R8 | | | | | | VPR | | | |
| R16 | OCT 5 | OCT 4 | OCT 3 | OCT 2 | OCT 1 | NOTE # | | | STRT |
| R17 | OCT 5 | OCT 4 | OCT 3 | OCT 2 | OCT 1 | NOTE # | | | BOT |
| R18 | OCT 5 | OCT 4 | OCT 3 | OCT 2 | OCT 1 | NOTE # | | | TOP |
| R19 | OCT 5 | OCT 4 | OCT 3 | OCT 2 | OCT 1 | NOTE # | | | CRNT |
| R10 | | | | | DSN FOR NOTE #1 | | | | DSN |
| R11 | | | | | DSN FOR NOTE #2 | | | | DECREASES |
| R12 | | | | | DSN FOR NOTE #3 | | | | ↓ |
| R13 | | | | | DSN FOR NOTE #4 | | | | ↓ |
| R14 | | | | | DSN FOR NOTE #5 | | | | ↓ |
| R20 | | | OCT 5 | OCT 4 | OCT 3 | OCT 2 | OCT 1 | OCT Ø | NOTE #1 |
| R21 | | | OCT 5 | OCT 4 | OCT 3 | OCT 2 | OCT 1 | OCT Ø | NOTE #2 |
| R22 | | | OCT 5 | OCT 4 | OCT 3 | OCT 2 | OCT 1 | OCT Ø | NOTE #3 |
| R23 | | | OCT 5 | OCT 4 | OCT 3 | OCT 2 | OCT 1 | OCT Ø | NOTE #4 |
| R24 | | | OCT 5 | OCT 4 | OCT 3 | OCT 2 | OCT 1 | OCT Ø | NOTE #5 |
| R64 | 0 | 1 | CØ | C5 | C4 | C3 | C2 | C1 | DSN = 0 |
| R65 | 0 | 1 | 0 | B5 | B4 | B3 | B2 | B1 | DSN = 1 |
| R66 | 0 | 0 | 1 | A#5 | A#4 | A#3 | A#2 | A#1 | DSN = 2 |
| R67 | 0 | 0 | 0 | A5 | A4 | A3 | A2 | A1 | DSN = 3 |
| R68 | 1 | 1 | 1 | G#5 | G#4 | G#3 | G#2 | G#1 | DSN = 4 |
| R69 | 1 | 1 | 0 | G5 | G4 | G3 | G2 | G1 | DSN = 5 |
| R70 | 1 | 0 | 1 | F#5 | F#4 | F#3 | F#2 | F#1 | DSN = 6 |
| R71 | 1 | 0 | 0 | F5 | F4 | F3 | F2 | F1 | DSN = 7 |
| R72 | 0 | 1 | 1 | E5 | E4 | E3 | E2 | E1 | DSN = 8 |
| R73 | 0 | 1 | 0 | D#5 | D#4 | D#3 | D#2 | D#1 | DSN = 9 |
| R74 | 0 | 0 | 1 | D5 | D4 | D3 | D2 | D1 | DSN = 10 |
| R75 | 0 | 0 | 0 | C#5 | C#4 | C#3 | C#2 | C#1 | DSN = 11 |
| R1 | MEASURE # | | QUARTER NOTE # | | 1/16 NOTE # | | 1/48 NOTE # | | RX |
| R2 | | | | | | | CDC | | |
| R 7 | | | | | | | | | |

NOTE: R64–75 use negative logic

TABLE 2

| | N4 = 0, NCNT < 4 | | | N4 = 1, NCNT = 4 or 5 | | | |
|---|---|---|---|---|---|---|---|
| DC | UDC | CHD | SKIP | UDC | CHD | SKIP | VPR |
| V2 + 0 | X | 1 | 01 | X | 1 | 10 | 3 (BANJO) |
| + 1 | 1 | 0 | 01 | 1 | 0 | 10 | |
| + 2 | 0 | 0 | 00 | 0 | 0 | 00 | |
| + 3 | 0 | 0 | 00 | 0 | 0 | 00 | |
| + 4 | 1 | 1 | 01 | 1 | 1 | 01 | |
| + 5 | 1 | 0 | 00 | 1 | 0 | 00 | |

TABLE 2-continued

| DC | N4 = 0, NCNT < 4 UDC | CHD | SKIP | N4 = 1, NCNT = 4 or 5 UDC | CHD | SKIP | VPR |
|---|---|---|---|---|---|---|---|
| + 6 | 0 | 0 | 00 | 0 | 0 | 00 | |
| + 7 | 0 | 0 | 00 | 0 | 0 | 00 | |
| + 8 | 0 | 1 | 00 | 0 | 1 | 01 | |
| + 9 | 1 | 0 | 01 | 1 | 0 | 10 | |
| + 10 | 0 | 0 | 00 | 0 | 0 | 00 | |
| + 11 | 0 | 0 | 00 | 0 | 0 | 00 | |
| + 12 | 1 | 1 | 01 | 1 | 1 | 01 | |
| + 13 | 1 | 0 | 00 | 1 | 0 | 00 | |
| + 14 | 0 | 0 | 00 | 0 | 0 | 00 | |
| + 15 | 0 | 0 | 00 | 0 | 0 | 00 | |
| V2 + 16 | X | 0 | 00 | X | 0 | 00 | 4 (GUITAR) |
| + 17 | 1 | 0 | 01 | 1 | 0 | 10 | |
| + 18 | 0 | 0 | 00 | 0 | 0 | 00 | |
| + 19 | 0 | 0 | 00 | 0 | 0 | 01 | |
| V2 + 20 | X | 0 | 00 | X | 0 | 00 | 5 (HARPSICHORD) |
| + 21 | 1 | 0 | 01 | 1 | 0 | 10 | |
| + 22 | 0 | 0 | 00 | 0 | 0 | 00 | |
| + 23 | 1 | 0 | 00 | 1 | 0 | 00 | |
| V2 + 24 | X | 0 | 00 | X | 0 | 00 | 6 (RINKYTINK) |
| + 25 | 0 | 0 | 00 | 0 | 0 | 00 | |
| + 26 | 0 | 0 | 00 | 0 | 0 | 00 | |
| + 27 | 0 | 0 | 00 | 0 | 0 | 00 | |
| + 28 | 1 | 0 | 01 | 1 | 0 | 01 | |
| + 29 | 0 | 0 | 00 | 0 | 0 | 00 | |
| + 30 | 0 | 0 | 00 | 0 | 0 | 00 | |
| + 31 | 1 | 0 | 00 | 1 | 0 | 00 | |
| + 32 | 0 | 0 | 00 | 0 | 0 | 00 | |
| + 33 | 1 | 0 | 00 | 1 | 0 | 00 | |
| + 34 | 1 | 0 | 00 | 1 | 0 | 00 | |
| + 35 | 1 | 0 | 00 | 1 | 0 | 00 | |
| + 36 | 0 | 0 | 01 | 0 | 0 | 01 | |
| + 37 | 1 | 0 | 00 | 1 | 0 | 00 | |
| + 38 | 1 | 0 | 00 | 1 | 0 | 00 | |
| + 39 | 0 | 0 | 00 | 0 | 0 | 00 | |
| V2 + 40 | X | 1 | 00 | X | 1 | 00 | 7 (FANTOM PIANO) |
| + 41 | 1 | 0 | 01 | 1 | 0 | 10 | |

TABLE 3

| | RHYTHM | | | | | | | |
|---|---|---|---|---|---|---|---|---|
| | Other Rhythms | | Ballad Rock Country Shuffle | | 6/8 March RX B4 = 0 | | 6/8 March RX B4 = 1 | |
| | VARIATIONS | | | | | | | |
| | 3 BIT 7 | 2 BIT 6 | 3 BIT 5 | 2 BIT 4 | 3 BIT 3 | 2 BIT 2 | 3 BIT 1 | 2 BIT 0 |
| RIGHT RX = 0 | 1 | 1 | 1 | 1 | 1 | 1 | 1 | 0 |
| 1 | 0 | 0 | 0 | 0 | 0 | 0 | 0 | 0 |
| 2 | 0 | 0 | 1 | 0 | 0 | 0 | 0 | 0 |
| 4 | 1 | 0 | 0 | 0 | 0 | 0 | 0 | 0 |
| 5 | 0 | 0 | 1 | 1 | 1 | 0 | 1 | 1 |
| 6 | 0 | 0 | 0 | 0 | 0 | 0 | 0 | 0 |
| 8 | 1 | 1 | 1 | 0 | 0 | 0 | 0 | 0 |
| 9 | 0 | 0 | 0 | 0 | 0 | 0 | 0 | 0 |
| 10 | 0 | 0 | 1 | 1 | 1 | 1 | 1 | 0 |
| 12 | 1 | 0 | 0 | 0 | 0 | 0 | 0 | 0 |
| 13 | 0 | 0 | 1 | 0 | 0 | 0 | 0 | 0 |
| 14 | 0 | 0 | 0 | 0 | 0 | 0 | 0 | 0 |

What is claimed is:

1. In an electronic musical instrument having an array of playing keys, an apparatus for generating arpeggios from one or more musical notes, said apparatus comprising:

a plurality of stored musical voice related patterns of tones, each pattern having a controlled number of sequential progressions;

musical voice priority means for selecting a dominant musical voice-related pattern of tones from said plurality of musical voice-related patterns of tones;

means for selecting a rhythm synchronization variation;

up/down flag means included in each musical voice-related pattern for controlling the upward or downward sequential progression of the pattern;

first memory means for storing data representing notes of the keys played and notes in higher octaves corresponding to the keys played;

second memory means for storing data representing the lowest note and highest note stored in said first memory means, the selected musical voice-related pattern, the selected rhythm synchronization variation, and the condition of the up/down flag means;

sequencing means for placing data representing the selected musical voice-related pattern for a current progression into said second memory means;

third memory means for receiving data from said first memory means;

selector means for scanning said first and second memory means and for placing one or more selected notes from the played and higher octave notes available in said first memory means into said third memory means in a progression controlled by the data stored in said second memory means;

processing means for generating from the data in said third memory means ouput pulses in said controlled progression; and audio output means for generating and sounding the notes of the selected musical voice-related pattern corresponding to said output pulses generated by said processing means, whereby an arpeggio commences upon the playing of one or more keys and continues until all the keys are released.

2. The apparatus as claimed in claim 1 wherein said audio output means sounds each note of the selected musical voice-related pattern as the processing means generates data for that note.

3. The apparatus as claimed in claim 1 wherein said first memory means stores data representing notes of the keys played for only the lowest played keys up to a predetermined number of keys.

4. The apparatus as claimed in claim 1 wherein said first memory means stores the exact positions of the played keys on a descending scale basis with respect to a preselected note with the lowest note stored first.

5. The apparatus of claim 1 wherein said processing means includes counter means for controlling the length of said output pulses applied to said audio output means.

6. The apparatus as claimed in claim 1 wherein said selector means initially detects data in said second memory means representing the lowest note stored in said first memory means and places the lowest note data from said first memory menas into said third memory means.

7. The apparatus as claimed in claim 1 including a first flag means for triggering said selector means to initially detect a note other than the lowest played note stored in said first memory means when said first flag means is in an active condition and wherein data representing the condition of said first flag means is stored in said second memory means.

8. The apparatus as claimed in claim 1 including second flag means for changing the upward progression of the arpeggio to a downward progression when the highest note in said first memory means is reached.

9. The apparatus as claimed in claim 1 including means for deactivating said selector means whenever the highest or lowest note of the group is reached.

10. The apparatus as claimed in claim 1 including means for producing a five-note trill by said audio output means whenever the highest or lowest note in the first memory means is reached.

11. The apparatus as claimed in claim 1 including a second flag means for triggering said selector means to place at least two notes from said first memory means into said third memory means when said second flag means is in an active condition for a current progression, a third flag means for triggering said selector means to skip at least one of the notes detected in said first memory means during the time said selector means places notes in said third memory means in a controlled progression when said third flag means is in an active condition and wherein data representing the conditions of said second and third flag means for a current progression are stored in said second memory means by said sequencing means.

12. The apparatus as claimed in claim 1 including fourth flag means for automatically reversing the direction of said selector means when said fourth flag means is in an active condition and wherein data representing the condition of said fourth flag means is stored in said second memory means.

13. The apparatus of claim 1 wherein said selector means includes a delay counter means for delaying the start of the controlled progression.

14. In an electronic musical instrument having an array of playing keys, an apparatus for generating arpeggios from one or more played keys, said apparatus comprising:

a plurality of stored musical voice-related patterns of tones, each pattern having a controlled number of sequenctial progressons;

musical voice means for selecting one of said plurality of musical voice-related patterns of tones;

means for selecting a rhythm synchronization variation;

first memory means for storing data representing notes of the keys played and notes of the same nomenclature in higher octaves;

second memory means for storing data representing the lowest note and highest note stored in said first memory means, said selected musical voice-related pattern, and the selected rhythm synchronization variation;

selector means for scanning said first and second memory means and for detecting in a controlled progression data repressenting a first note in said first memory means and then data repressenting additional notes from the notes stored in said first memory means;

up/down flag means included in each musical voice-related pattern for controlling the direction of said selector means;

processing means for rearranging and storing the data detected by said selector means in said first memory means and generating output pulses in a controlled progression , said up/down flag means controlling the direction of said controlled progression; and audio output means for generating and sounding the notes of the selected musical voice-related pattern corresponding to said output pulses generated by said processing means, whereby an arpeggio commences upon the playing of one or more keys and continues until all the keys are released.

15. A method for automatically generating arpeggios from an array of playing keys in an electronic musical instrument comprising the steps of:

selecting at least one musical voice-related pattern of tones from which tonal sequences will be sounded;

selecting a rhythm synchronization variation;

selecting an upward or downward sequential progression for the arpeggio;

storing data in a first random access memory representing the notes of keys played and the notes in higher octaves corresponding to the keys played;

storing data in a second random access memory representing the lowest note and highest note stored in said first random access memory, the selected musical voice-related pattern, and the direction of a current progression of the arpeggio;

scanning said first and second random access memories and selecting the stored data representing the note of the lowest played key from said first random access memory and storing said data in a third random access memory, then selecting additional notes from the notes available in the first random access memory according to the data stored in the second random access memory and storing those notes in said third random access memory ; and sounding each note stored in said third random access memory in accordance with the selected musical voice-related pattern.

16. The method of claim 15 including the step of storing at least three notes of a chord in said random access memory even if just one note is played.

17. The method of claim 15 including the step of scanning said random access memory by starting at the beginning or in the middle of the stored data.

18. The method of claim 15 including the step of reversing the direction of scanning whenever the highest or lowest note represented by the stored data is reached.

19. The method of claim 15 including the step of reversing the direction of scanning whenever the highest or lowest note represented by the stored data is exceeded.

20. The method of claim 15 including the step of stopping the scanning whenever the highest or lowest note represented by the stored data is detected.

21. The method of claim 15 including the step of stopping the scanning whenever the highest or lowest note stored in said second random access memory is exceeded.

22. The method of claim 15 including the step of sounding a five-note tril whenever the highest or lowest note represented by the stored data is detected or exceeded.

23. The method of claim 15 including the step of skipping stored data representing at least one note during scanning.

24. The method of claim 15 including the step of scanning for stored data representing another not to be sounded simultaneously with the detected note.

25. The method of claim 15 including the step of reversing the direction of scanning when the first flag in said second random access memory is in an active condition.

26. The method of claim 15 including the step of limiting the arpeggio range in forming a particular arpeggio to an integral number of octaves relative to the starting note of the arpeggio.

27. The method of claim 15 including the step of limiting the notes sounded in forming a particular arpeggio to an integral number of octaves.

28. The method of claim 15 including the step of sounding various combinations of voices with the first voice-related pattern chosen having priority.

29. The method of claim 15 including the step of implementing a first sequence when selecting notes for the arpeggio is in an upward sequential progression and a second sequence when selecting notes for the arpeggio is in a downward sequential progression.

30. The method of claim 15 including the step of sounding the last note at the end of the arpeggio twice.

31. The method of claim 15 including the step of scanning upward and downward for data representing the notes stored in said first random access memory to produce various sized note groups, chords, and up-down sequences thereby allowing the arpeggio to initially progress upward or downward depending upon the active conditions of the selected sequential progressions.

32. The method of claim 23 including the step using a first look up table to control the skipping of stored data and using a second look up table to control the skipping of stored data when more than three notes per octave are available in the stored data.

* * * * *

UNITED STATES PATENT AND TRADEMARK OFFICE

CERTIFICATE OF CORRECTION

PATENT NO. : 4,444,081

DATED : April 24, 1984

INVENTOR(S) : Edward M. Jones and Carlton J. Simmons, Jr.

It is certified that error appears in the above—identified patent and that said Letters Patent is hereby corrected as shown below:

Col. 3, line 38, "first" (first occurrence) should be omitted.

Col. 3, line 60, "simple major" should be --simple C major--.

Col. 3, line 65, "The" should be --the--.

Col. 5, line 13, "registers, Table" should be --registers R10-R14, Table--.

Col. 5, line 20, "o" should be --on--.

Col. 5, line 27, "on" should be --one--.

Col. 5, line 33, "identifies voice" should be --identifies which voice--.

Col. 6, line 30, "voice harp" should be --fantom harp--.

Col. 6, line 33, "fantom buttons" should be --voice buttons--.

Col. 6, line 20, "Flag" should be --flag--.

UNITED STATES PATENT AND TRADEMARK OFFICE

CERTIFICATE OF CORRECTION

PATENT NO. : 4,444,081

DATED : April 24, 1984

INVENTOR(S) : Edward M. Jones and Carlton J. Simmons, Jr.

It is certified that error appears in the above—identified patent and that said Letters Patent is hereby corrected as shown below:

Col. 6, line 35, "equals the latches" should be --equals 1, the latches--.

Col. 7, line 47, "equal" should be --equals--.

Col. 8, line 25, after "it should", do not start a new paragraph.

Col. 11, line 34, insert "6." after and.

Col. 11, line 64, insert "a" after stores.

Col. 12, line 10, "60" should be --160--.

Col. 12, line 28, "occur" should be --occur:--.

Col. 13, line 29, "micro-processor" should be --microprocessor--.

Col. 13, line 57, "th" should be --the--.

Col. 15, line 22, "exeouted" should be --executed--.

Col. 15, line 60, after "also", do not start a new paragraph.

UNITED STATES PATENT AND TRADEMARK OFFICE

CERTIFICATE OF CORRECTION

PATENT NO. : 4,444,081

DATED : April 24, 1984

INVENTOR(S) : Edward M. Jones and Carlton J. Simmons, Jr.

It is certified that error appears in the above—identified patent and that said Letters Patent is hereby corrected as shown below:

Col. 17, Table 1, "R 7" should be --R7--.

Col. 21, line 10, "ouput" should be --output--

Col. 22, line 19, "sequenctial" should be --sequential--.

Col. 22, line 19, "progressons" should be --progressions--.

Col. 22, line 35, "repressenting" should be --representing--.

Col. 23, line 39, "tril" should be --trill--.

Col. 24, line 5, "not" should be --note--.

Col. 24, line 8, "the" should be --a--.

Signed and Sealed this

*Twenty-ninth* Day of *January 1985*

[SEAL]

*Attest:*

DONALD J. QUIGG

*Attesting Officer* *Acting Commissioner of Patents and Trademarks*